US007595447B2

(12) United States Patent
Vrame

(10) Patent No.: US 7,595,447 B2
(45) Date of Patent: Sep. 29, 2009

(54) DUAL-SIDED MOUNTING BRACKET FOR ELECTRICAL JUNCTION BOXES

(76) Inventor: Peter A. Vrame, 381 Spring Creek Rd., Barrington Hills, IL (US) 60014

( * ) Notice: Subject to any disclaimer, the term of this patent is extended or adjusted under 35 U.S.C. 154(b) by 0 days.

(21) Appl. No.: 11/973,579

(22) Filed: Oct. 9, 2007

(65) Prior Publication Data

US 2008/0083552 A1 Apr. 10, 2008

Related U.S. Application Data

(60) Provisional application No. 60/850,618, filed on Oct. 10, 2006.

(51) Int. Cl.
*H01R 13/46* (2006.01)

(52) U.S. Cl. ..... 174/58; 174/57; 174/61; 174/63; 248/906

(58) Field of Classification Search ..... 174/480, 174/481, 50, 53, 54, 57, 58, 61, 62, 63; 220/3.2–3.9, 220/4.02; 248/343, 906, 228.6, 121, 127, 248/200, 220.1, 207, 205.2
See application file for complete search history.

(56) References Cited

U.S. PATENT DOCUMENTS 4,757,967 A * 7/1988 Delmore et al. ..... 248/906
4,964,525 A * 10/1990 Coffey et al. ..... 248/906
5,452,873 A * 9/1995 Laughlin ..... 248/906
5,927,667 A * 7/1999 Swanson ..... 248/906
5,931,425 A * 8/1999 Oliva ..... 174/58
6,573,449 B2 * 6/2003 Vrame ..... 174/58
6,765,146 B1 * 7/2004 Gerardo ..... 174/58
7,053,300 B2 * 5/2006 Denier et al. ..... 174/58
7,173,186 B1 2/2007 Hageman
7,271,336 B2 * 9/2007 Dinh ..... 174/58

* cited by examiner

*Primary Examiner*—Angel R Estrada
(74) *Attorney, Agent, or Firm*—Wood, Phillips, Katz, Clark & Mortimer

(57) ABSTRACT

In a dual-sided mounting bracket for electrical junction boxes, wherein the mounting bracket comprises first and second stud coupling members and first and second junction box receiving members adjacent the respective stud coupling members, and an offset portion interposed between the first and second junction box receiving sections, and wherein each junction box receiving section has two expansive sides and two lengthwise extending edges and is adapted for mounting an electrical junction box or electrical junction boxes to a given one of the expansive sides of such junction box receiving section, each junction box receiving section has two flanges, each extending along a given one of the lengthwise extending edges of such junction box receiving section and projecting from the other one of the expansive sides of such junction box receiving section, so as to project away from an electrical junction box or electrical junction boxes mounted to the given one of the expansive sides of such junction box receiving section. Each junction box receiving section has a single tab, which can be bent back so as to support said junction box receiving station against an adjacent wall panel, and which can be bent back along either of two bending lines, so as to accommodate either of two spacings from the adjacent wall panel.

4 Claims, 2 Drawing Sheets

DUAL-SIDED MOUNTING BRACKET FOR ELECTRICAL JUNCTION BOXES

TECHNICAL FIELD OF THE INVENTION

This invention pertains to improvements in a dual-sided mounting bracket for electrical junction boxes.

BACKGROUND OF THE INVENTION

A dual-sided mounting bracket for electrical junction boxes is disclosed in U.S. patent application Ser. No. 11/356,836, which was filed on Feb. 21, 2006, by Dale A. Hageman, and the disclosure of which is incorporated herein by reference. The mounting bracket is adapted for being mounted between to studs in a wall between two adjacent rooms. Being dual-sided, the mounting bracket is used to mount electrical junction boxes facing oppositely, so as to serve the adjacent rooms.

As disclosed in U.S. patent application Ser. No. 11/356,836, a dual-sided mounting bracket for electrical junction boxes comprises a first stud coupling member, a second stud coupling member, a first junction box receiving section adjacent the first stud coupling member, a second junction box receiving section adjacent the second stud coupling member, and an offset portion interposed between the first junction box receiving station and the second junction box receiving section.

Improvements in a dual-sided mounting bracket, as described above, are disclosed in U.S. Provisional Patent Application No. 60/847,001, which was filed on Sep. 25, 2006, and the disclosure of which is incorporated herein by reference.

SUMMARY OF THE INVENTION

This invention provides, among other improvements in a dual-sided mounting bracket for electrical junction boxes, wherein the mounting bracket comprises a first stud coupling member, a second stud coupling member, a first junction box receiving member adjacent the first stud coupling member, a second junction box receiving section adjacent the second stud coupling member, and an offset portion interposed between the first and second junction box receiving sections, and wherein each junction box receiving section has two expansive sides and two lengthwise extending edges and is adapted for mounting an electrical junction box or electrical junction boxes to a given one of the expansive sides of said junction box receiving section.

This invention provides an improvement wherein each junction box receiving section has a flange extending along a given one of the lengthwise extending edges of said junction box receiving section and projecting from the other one of the expansive sides of said junction box receiving section, so as to project away from an electrical junction box or electrical junction boxes mounted to the given one of the expansive sides of said junction box receiving section.

The flange may be one of two flanges, each extending along a respective one of the lengthwise extending edges and projecting from the other one of the expansive sides of said junction box receiving section, so as to project away from an electrical junction box or electrical junction boxes mounted to the given one of the expansive sides of said junction box receiving section.

This invention provides an improvement wherein each junction box receiving section has a single tab, which can be bent back so as to support said junction box receiving station against an adjacent wall panel.

The single tab may have a bending line, where the single tab is joined to the remainder of said junction box receiving station, and a bending line between a distal end of the single tab and the bending line mentioned before, so that the single tab can be bent back along either bending line, so as to accommodate either of two spacings from the adjacent wall panel.

In a mounting bracket according to this invention, one, some, or all of these improvements may be advantageously embodied. Other improvements provided by this invention are described, hereinbelow, in the detailed description of the illustrated embodiments.

BRIEF DESCRIPTION OF THE DRAWINGS

In the accompanying drawings.

DETAILED DESCRIPTION OF THE ILLUSTRATED EMBODIMENTS

Figure 1:
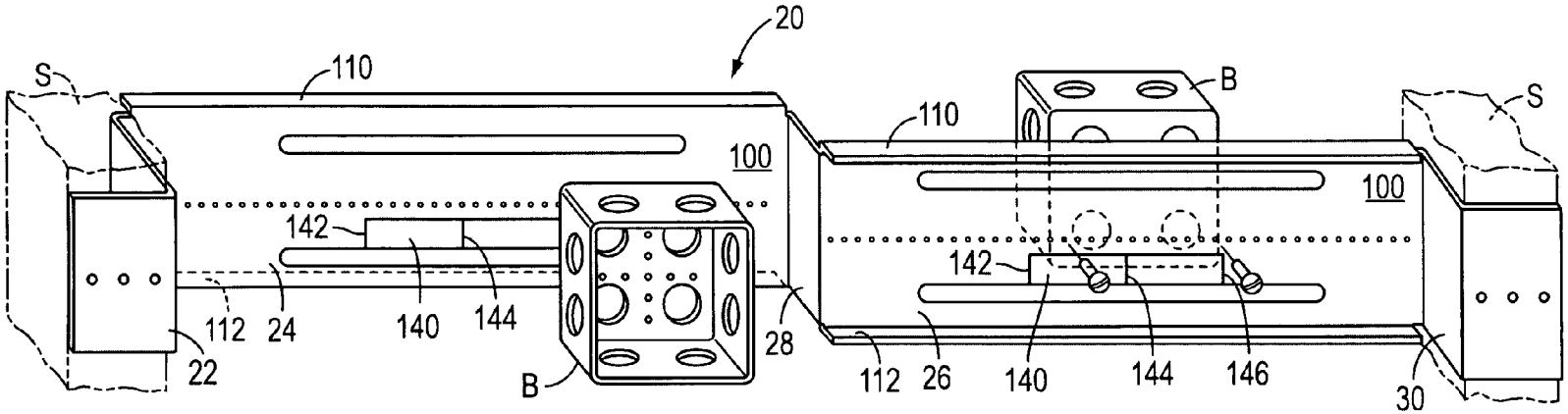
FIG. 1 is a front, perspective view of a first embodiment of a mounting bracket according to this invention.

In each of the first and second embodiments, a mounting bracket 20, which is adapted for being mounted to and between two studs S in a wall serving two adjacent rooms and which is adapted to mount electrical junction boxes B facing frontwardly and electrical junction boxes B faxing backwardly so as to serve the adjacent rooms, comprises a first stud coupling member 22, a first junction box receiving section 24, a second junction box receiving section 26, an offset portion 28 interposed between the first junction box receiving station 24 and the second junction box receiving station 26, and a second stud coupling member 30. Preferably, the mounting bracket 20 is stamped from galvanized steel, either 18 gauge or 20 gauge.

In the first embodiment, wherein the mounting bracket 20 is suitable for mounting to and between studs spaced approximately twenty-four inches from each other, the first and second junction box receiving sections 24, 26, have approximately equal lengths. In the second embodiment, wherein the mounting bracket 20 is suitable for mounting to and between studs spaced approximately sixteen inches from each other, the first junction box receiving section 24 is approximately twice as long as the second junction box receiving section 26. In each of the first and second embodiments, the offset portion 28 meets each of the first and second junction box receiving sections 24, 26, at approximately a right angle. In each of the first and second embodiments, the mounting bracket 20 is approximately two and one-half inches wide.

In each of the first and second embodiments, each junction box receiving section 24, 26, has two expansive sides 100, 102, and two lengthwise extending edges. Further, each junction box receiving section 24, 26, is adapted for mounting an electrical junction box B or electrical junction boxes B to a given one of the expansive sides 100, 102, of said junction box receiving section 24, 26.

As provided by this invention, each junction box receiving section 24, 26, has two flanges 110, 112, each extending along a given one of the lengthwise extending edges, of said junction box receiving section 24, 26, and projecting from the other one of the expansive sides 100, 102, of said junction box receiving section 24, 26, so as to project away from an electrical junction box B or electrical junction boxes B mounted to the given one of the expansive sides of said junction box receiving section 24, 26.

The flanges 110, 112, reinforce the junction box receiving sections 24, 26, against bending. The mounting bracket 20 can be thus made from a light-gauge material, such as galvanized steel of 18 gauge or 20 gauge.

Whereas each junction box receiving station of the mounting bracket disclosed in U.S. Provisional Patent Application No. 60/847,001, supra, has plural tabs, which may be also called box back supports, each junction box receiving station 24, 26, of the mounting bracket 20 disclosed herein has a single tab 140, which may be also called a box back support.

Figure 2:
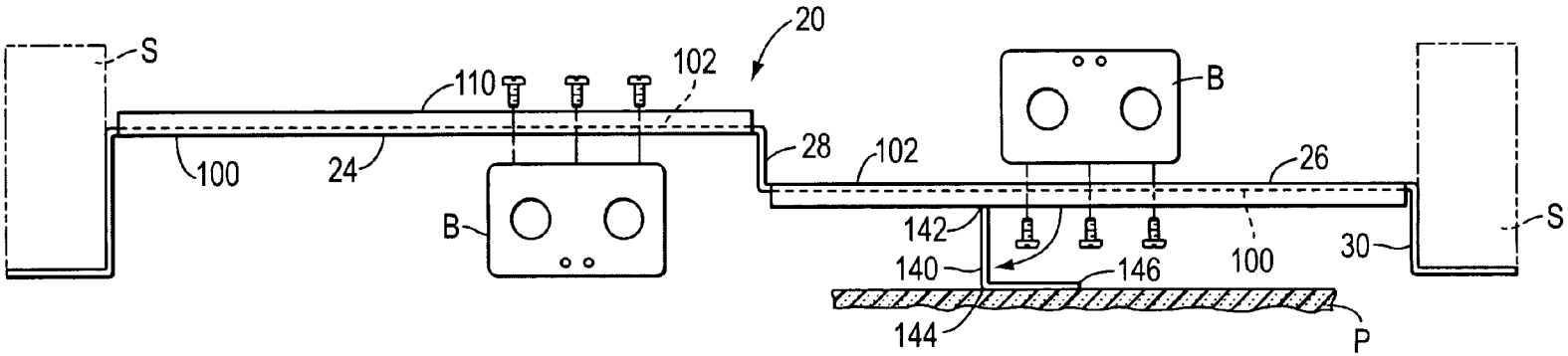
FIG. 2 is a top plan of the first embodiment. Moreover.
Figure 3:
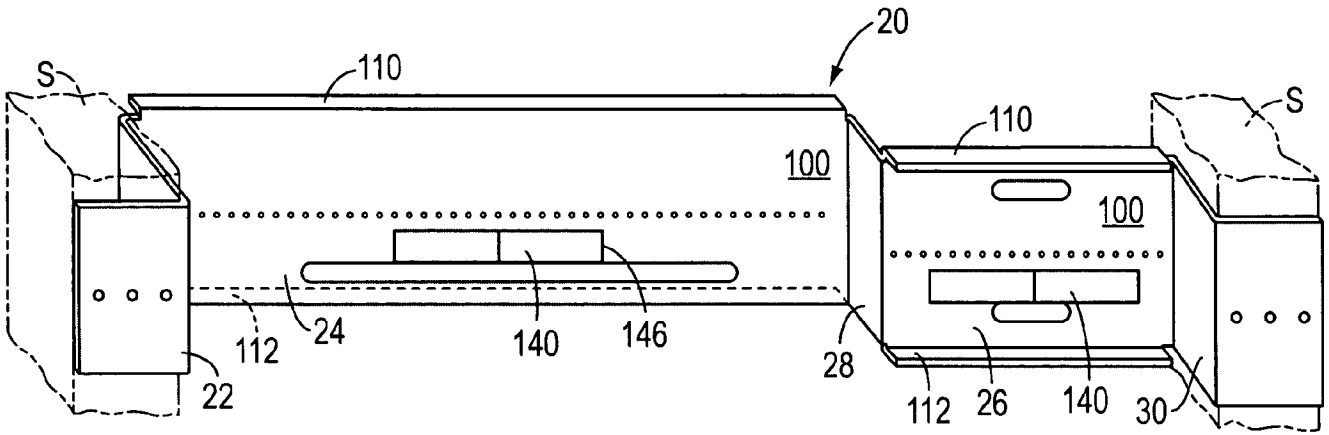
FIG. 3 is a front, perspective view of a second embodiment of a mounting bracket according to this invention
Figure 4:
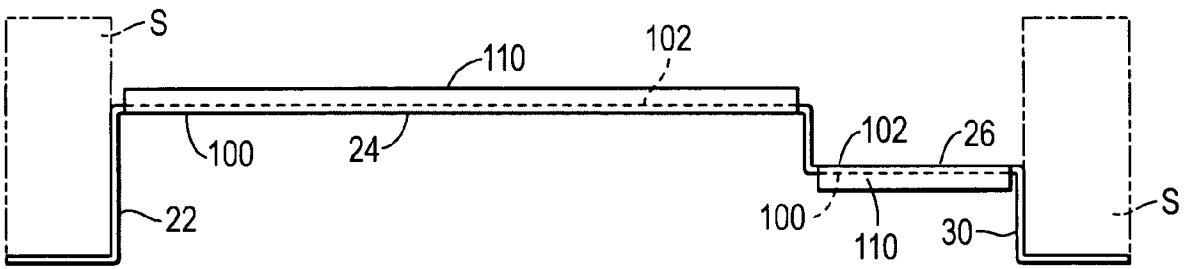
FIG. 4 is a top plan of the second embodiment.

As illustrated in FIG. 2, the single tab 140 of each junction box receiving station 24, 26, can be bent back so as to support said junction box receiving station 24, 26, against an adjacent drywall panel P. The single tab 140 has a bending line 142, where the single tab 140 is joined to the remainder of said junction box receiving station 24, 26, and a bending line 144, between a distal end 146 of the single tab 140 and the bending line 142, so that the single tab 140 can be bent back along either bending line 142, 144, so as to accommodate either of two commonly encountered spacings from the adjacent drywall panel P, such as a spacing of three and one-half inches or a spacing of six inches.

The invention claimed is:

1. In a dual-sided mounting bracket for electrical junction boxes, wherein the mounting bracket comprises a first stud coupling member, a second stud coupling member, a first junction box receiving section adjacent the first stud coupling member, a second junction box receiving section adjacent the second stud coupling member, and an offset portion interposed between the first and second junction box receiving sections, and wherein each junction box receiving section has two expansive sides and two lengthwise extending edges and is adapted for mounting an electrical junction box or electrical junction boxes to a given one of the expansive sides of said junction box receiving section, an improvement wherein each junction box receiving section has a flange extending along a given one of the lengthwise extending edges of said junction box receiving section and projecting from the other one of the expansive sides of said junction box receiving section, so as to project away from an electrical junction box or electrical junction boxes mounted to the given one of the expansive sides of said junction box receiving section, wherein each of said first and second junction box receiving sections define a plurality of longitudinally-aligned, spaced apart openings for receiving associated mechanical fasteners therethrough for selectively mounting associated junction boxes on each of said first and second junction box receiving sections.

2. The improvement of claim 1, wherein the flange is one of two flanges, each extending along a respective one of the lengthwise extending edges and projecting from the other one of the expansive sides of said junction box receiving section, so as to project away from an electrical junction box or electrical junction boxes mounted to the given one of the expansive sides of said junction box receiving section.

3. In a dual-sided mounting bracket for electrical junction boxes, wherein the mounting bracket comprises a first stud coupling member, a second stud coupling member, a first junction box receiving section adjacent the first stud coupling member, a second junction box receiving section adjacent the second stud coupling member, and an offset portion interposed between the first and second junction box receiving sections, and wherein each junction box receiving section has two expansive sides and two lengthwise extending edges and is adapted for mounting an electrical junction box or electrical junction boxes to a given one of the expansive sides of said junction box receiving section, an improvement wherein each junction box receiving section has a single tab, which can be bent back so as to support said junction box receiving station against an adjacent wall panel, wherein each of said first and second junction box receiving sections define a plurality of longitudinally-aligned. spaced apart openings for receiving associated mechanical fasteners therethrough for selectively mounting associated function boxes on each of said first and second junction box receiving sections.

4. The improvement of claim 3, wherein the single tab has a first bending line, where the single tab is joined to the remainder of said junction box receiving station, and a second bending line between a distal end of the single tab and the first bending line, so that the single tab can be bent back along either bending line, so as to accommodate either of two spacings from the adjacent wall panel.

* * * * *